US009718581B2

(12) United States Patent
Schütz

(10) Patent No.: US 9,718,581 B2
(45) Date of Patent: Aug. 1, 2017

(54) PALLET-LIKE UNDERFRAME FOR TRANSPORT AND STORAGE CONTAINERS FOR LIQUIDS

(75) Inventor: Udo Schütz, Selters (DE)

(73) Assignee: PROTECHNA S.A., Fribourg (CH)

( * ) Notice: Subject to any disclaimer, the term of this patent is extended or adjusted under 35 U.S.C. 154(b) by 750 days.

(21) Appl. No.: 13/419,536

(22) Filed: Mar. 14, 2012

(65) Prior Publication Data

US 2012/0261303 A1 Oct. 18, 2012

(30) Foreign Application Priority Data

Apr. 18, 2011 (DE) ..... 10 2011 007 583

(51) Int. Cl.
*B65D 19/40* (2006.01)
*B65D 21/02* (2006.01)
*B65D 77/04* (2006.01)

(52) U.S. Cl.
CPC ..... *B65D 21/0213* (2013.01); *B65D 19/40* (2013.01); *B65D 77/0466* (2013.01)

(58) Field of Classification Search
CPC B65D 21/0213; B65D 77/0466; B65D 19/40; B65D 19/385; B65D 19/44; B65D 19/38; B65D 19/06
USPC ..... 206/599, 386; 220/9.1, 9.4, 495.05, 1.5, 220/1.6; 108/51.11
See application file for complete search history.

(56) References Cited

U.S. PATENT DOCUMENTS 5,499,438 A 3/1996 Schutz
6,050,437 A * 4/2000 Schutz ..... 220/4.12
6,550,628 B1 * 4/2003 Sedlmayr ..... 220/9.1
6,719,164 B2 * 4/2004 Maschio ..... 220/571
7,036,662 B2 * 5/2006 Schutz ..... 206/386
7,762,393 B2 * 7/2010 Schutz ..... 206/386
7,866,501 B2 * 1/2011 Schutz ..... 220/23.91
2002/0112979 A1 * 8/2002 Maschio ..... 206/386
2004/0149610 A1 * 8/2004 Schutz ..... 206/386
(Continued)

FOREIGN PATENT DOCUMENTS

CN 101508378 A 8/2009
CN 101519149 A 9/2009
(Continued)

OTHER PUBLICATIONS

European Patent Office, Search Report, EP 12161093.5, Jul. 11, 2012.

(Continued)

*Primary Examiner* — Steven A. Reynolds
(74) *Attorney, Agent, or Firm* — Quarles & Brady LLP

(57) ABSTRACT

A pallet-like underframe has a base for supporting an inner container and corner feet mounted on a base frame on which the base of the underframe is mounted. The corner feet include a cup-shaped corner foot body having a front wall and cup parts formed to the side of a central axis of the front wall. The cup parts each include an inwardly bent edge web. The edge web includes an upper edge web section, a lower edge web section, and a lateral edge web section formed between the upper and the lower edge web section on a side edge of the front wall. The upper edge web section, the lateral edge web section, and the lower edge web section are configured to go over into one another continuously in edge web forming regions.

6 Claims, 2 Drawing Sheets

(56) References Cited

U.S. PATENT DOCUMENTS

| | | | | |
|---|---|---|---|---|
| 2005/0092639 | A1* | 5/2005 | Schutz | 206/386 |
| 2005/0133514 | A1* | 6/2005 | Schutz | 220/630 |
| 2005/0196252 | A1* | 9/2005 | Schutz | 411/501 |
| 2007/0039955 | A1 | 2/2007 | Schutz | |
| 2009/0212048 | A1* | 8/2009 | Schutz | 220/4.12 |
| 2009/0223847 | A1* | 9/2009 | Schutz | 206/386 |
| 2009/0230017 | A1* | 9/2009 | Schutz | 206/599 |
| 2010/0025275 | A1* | 2/2010 | Cassina | 206/386 |
| 2012/0055830 | A1* | 3/2012 | Schutz | 206/386 |
| 2012/0211395 | A1* | 8/2012 | Schutz | 206/599 |
| 2012/0279898 | A1* | 11/2012 | Schutz | 206/599 |

FOREIGN PATENT DOCUMENTS

| | | | |
|---|---|---|---|
| DE | 202 17 856 | U1 | 2/2003 |
| DE | 20316883 | U1 | 3/2004 |
| DE | 202004003020 | U1 | 4/2004 |
| JP | 2005246481 | A | 9/2005 |
| RU | 2086486 | C1 | 8/1997 |

OTHER PUBLICATIONS

English Translation of Japan Patent Office Notice of Reasons for Rejections, JP Patent Application No. 2012-090995, May 14, 2013, 3 pages.

State Intellectual Property Office of People's Republic of China, First Office Action, Application No. 201210113391.9, Dec. 23, 2013,11 pages.

* cited by examiner

PALLET-LIKE UNDERFRAME FOR TRANSPORT AND STORAGE CONTAINERS FOR LIQUIDS

CROSS REFERENCE TO RELATED APPLICATION

The present application claims the benefit of German Patent Application No. 10 2011 007 583.6 filed Apr. 18, 2011, which is fully incorporated herein by reference.

STATEMENT REGARDING FEDERALLY SPONSORED RESEARCH OR DEVELOPMENT

Not applicable.

FIELD OF THE INVENTION

The present invention relates to a pallet-like underframe, in particular for transport and storage containers for liquids, which are equipped with a plastic inner container with a closable filler connection and a drain connection for connection to a drain fitting and an outer jacket comprising a metal grid or sheet metal, where the underframe has a base for supporting the inner container and corner and middle feet made of metal which are mounted on a base frame and on which the base of the underframe is mounted, where the corner feet comprise a cup-shaped corner foot body having a front wall curved in accordance with a corner radius of a frame corner of the base frame and cup parts formed to the side of a central axis of the front wall, where the cup parts each comprise an edge web formed on the peripheral edge of the front wall and bent inwards, comprising an upper edge web section for connection of the corner foot to the ground, a lower edge web section for connection to the base frame and a lateral edge web section formed between the upper and the lower edge web section on a side edge of the front wall.

BACKGROUND OF THE INVENTION

A pallet-like underframe of the type specified initially is known, for example, from DE 202 17 856 U1. The known underframe comprises corner feet located at the frame corners of the base frame which comprise a corner base body with two cup parts configured to go over into one another in the area of a central axis. The cup parts each have an upper edge web section and a lower edge web section at the upper edge of the front wall and at the lower edge of the front wall, which are bent substantially at right angles to the front wall. Here the upper edge web section is used for connection to the base of the underframe and the lower edge web section is used for connection to the base frame of the underframe.

At the side edges of the front wall the cup parts are provided with a lateral edge web section which each consist of a tab-shaped sheet metal tongue formed at the side edge of the front wall, which is rolled inwardly and thus forms a stiffening element, which with its axial ends respectively supports the upper edge web section and the lower edge web section without the axial ends of the stiffening element being connected to the edge web sections.

In the known corner feet the stiffening elements in particular enable an effective stiffening of the edge web sections with respect to one another and therefore a corresponding increase in the stability of the corner feet, in particular under loading of the corner feet parallel to the central axis of the corner feet. A corresponding case of loading is given for example by the static loading of the corner feet or the underframe caused by the liquid-filled inner container of a transport and storage container. A maximum static loading is thus obtained in a stack arrangement comprising a plurality of transport and liquid containers arranged above one another.

In a case of loading in which the static load does not act parallel to the central axis of the corner foot or under a dynamic loading of the corner foot which can occur, for example, when handling a transport and storage container or as a result of a container falling or a non-uniform placement of the container on the subfloor, increased shear forces must be transferred between the upper and lower edge web section via the stiffening elements so that the stiffening elements formed by the lateral edge web sections should be configured or dimensioned accordingly stably. In principle, however, it is desirable to use the thinnest possible metal sheets to manufacture the corner feet to save material and weight.

SUMMARY OF THE INVENTION

The invention starts from the basic consideration to increase the stability of the stiffening elements for transmission of the shear stress by connecting the axial ends of the stiffening element to the neighbouring edge web sections. This can be accomplished, for example, by a seamless connection in the manner of a welded connection between the axial ends of the stiffening elements and the neighbouring edge web sections. A disadvantage with a connection formed in this way however is that a separate processing step is required as a result during the manufacture of the corner feet.

It is therefore the object of the present invention to provide a pallet-like underframe for a transport and storage container for liquids which has an increased stability in order to thus enable the provision of transport and storage containers for liquids which ensure an increased security against container failure caused by inadequate stability of the underframe and which are therefore particularly suitable for the transport and storage of hazardous goods.

In order to solve this object the underframe according to one embodiment of the invention includes corner feet and a base for supporting an inner container. The corner feet are mounted on a base frame on which the base of the underframe is mounted. A corner foot of the corner feet includes a cup-shaped corner foot body having a front wall curved in accordance with a corner radius of a frame corner of the base frame and cup parts formed to the side of a central axis of the front wall. The cup parts each comprise an inwardly bent edge web formed on a peripheral edge of the front wall. The edge web includes an upper edge web section for engagement of the corner foot to the ground, a lower edge web section for connection to the base frame, and a lateral edge web section formed between the upper and the lower edge web section on a side edge of the front wall. The upper edge web section, the lateral edge web section, and the lower edge web section are configured to go over into one another continuously in edge web forming regions.

In the underframe according to the invention, the upper edge web section, the lateral edge web section and the lower edge web section are configured to go over into one another continuously in edge web forming regions.

In the underframe according to the invention, the ends of the lateral edge web section are therefore connected in one piece to the upper and the lower edge web section without special connections which must possibly be made in separate processing processes being required. On the contrary, the connection between the lateral edge web section, the upper and the lower edge web section is made by a forming process of a sheet metal blank which is part of the forming process which is required to form or shape the cup-like corner foot body or the cup parts of the corner foot body.

A particular stability of the edge web forming regions is rendered possible if these are formed as spatial corner regions of the cup parts since these corner regions can absorb forces in all three force directions of the space.

A further stiffening of the underframe can be achieved by forming stiffening beads in the front wall of the corner feet, which extend between the upper edge web section and the lower edge web section and have a bead base which is inclined with respect to a front plane defined by the front wall towards a connecting edge of the lower edge web section. In particular an efficient stiffening is thereby possible in a pallet-like underframe whose base frame is configured to be smaller than the base of the underframe, which is particularly the case if the transport and storage containers are to be stackable so that in a stacked arrangement one above the other, the lower edge of the corner feet is not only used for connection to the base frame but at the same time for support on an upper edge of the outer jacket of a lower transport and storage container. In such a stack arrangement the base frame of the upper transport and storage container is then located inside a surface enclosed by the upper edge of the outer jacket of the lower transport and storage container.

For a defined relative arrangement of transport and storage containers stacked one above the other, it is also found to be particularly advantageous if stop tabs are disposed on the lower edge web section between the peripheral edge of the front wall and the connecting edge, which by their distance from the peripheral edge define a contact edge for support on an outer jacket of a transport and storage container. The stop tabs thereby enable a quasi-centred arrangement of the upper transport and storage container with respect to the lower transport and storage container in such a manner that a defined distance formed circumferentially between the base frame and the upper edge is produced so that an undesirable tilting of the transport and storage container can be avoided in a stack arrangement and therefore it is easier to produce a stack arrangement and to break up a stack arrangement by separating from one another the transport and storage containers stacked one upon the other and the formation of corresponding hazardous situations can be avoided.

In order to produce a base for a pallet-like underframe for a transport and storage container for liquids, in a first process step a flat sheet metal blank is formed in a deep drawing process in such a manner that a corner foot moulding is formed having two cup parts formed laterally of a central axis of a base wall, where the front wall is composed of two jacket segments curved in the same direction, which go over into one another in the area of the central axis and the cup parts on the peripheral edge of the base wall each comprise an edge web formed continuously from an upper edge web section, a lateral edge web section and a lower edge web section, located substantially at right angles to the base wall.

According to the invention, in a subsequent process step during the manufacture of the corner foot the jacket segments are pivoted with respect to one another about the central axis in such a manner that the jacket segments form a front wall having a substantially continuous radius of curvature.

A preferred embodiment of a pallet-like underframe for transport and storage containers is explained in detail hereinafter with reference to the drawing.

DETAILED DESCRIPTION OF THE EXAMPLE EMBODIMENTS

Figure 1:
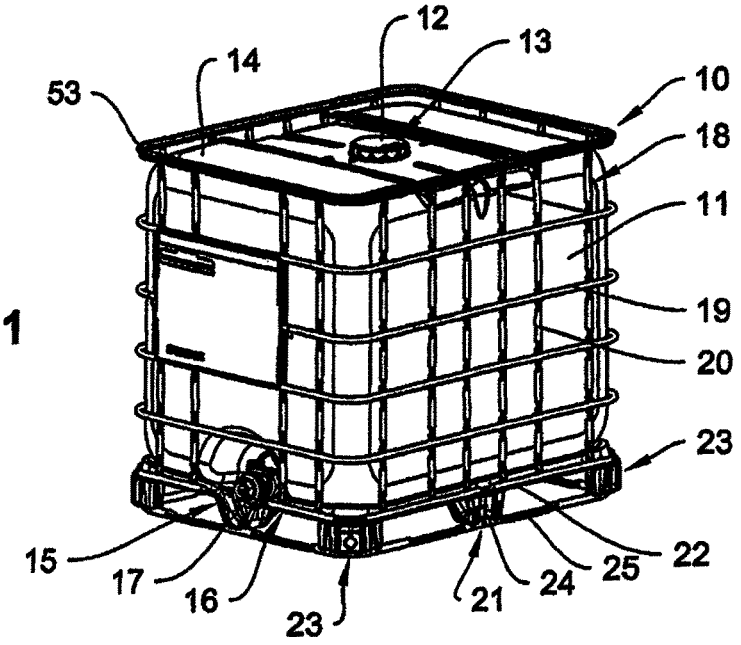
FIG. 1 shows a perspective view of transport and storage container for liquids equipped with a pallet-like underframe.

FIG. 1 shows a transport and storage container 10 for liquids which can be used as a disposable or re-usable container comprising an inner container 11 made of plastic which is equipped with a filler connection 13 which can be closed by a cover 12 in the upper container base 14 and a drain connection 15 in the area of a lower container base 16 for connection of a drain fitting 17. The inner container 11 is accommodated exchangeably in an outer jacket 18 of intersecting horizontal and perpendicular metal grating bars 19, 20 which like the inner container 11 is located on a pallet-like underframe 21.

The underframe 21 has a base 22 for supporting the inner container 11 as well as corner feet 23 and middle feet 24 which are mounted on a base frame 25 and on which the base 22 and the outer jacket 18 of the inner container 11 are fastened.

Figure 2:
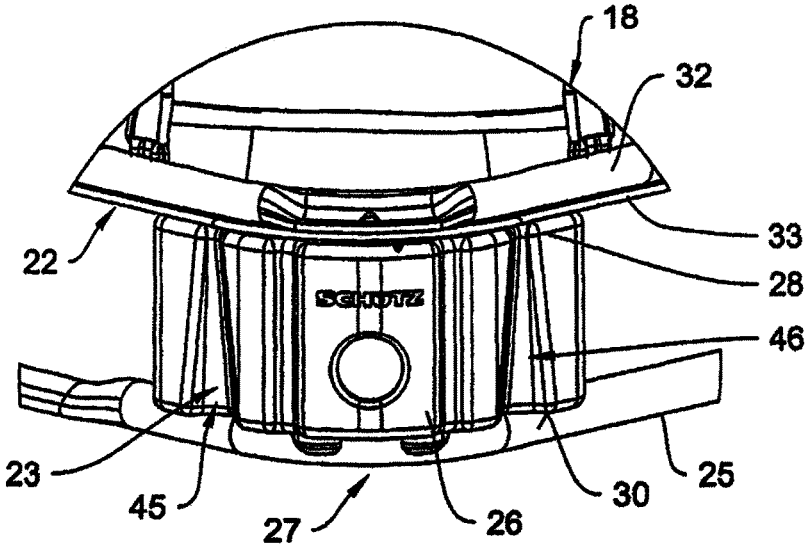
FIG. 2 shows an enlarged view of a corner region of the underframe of the transport and storage container shown in FIG. 1.
Figure 3:
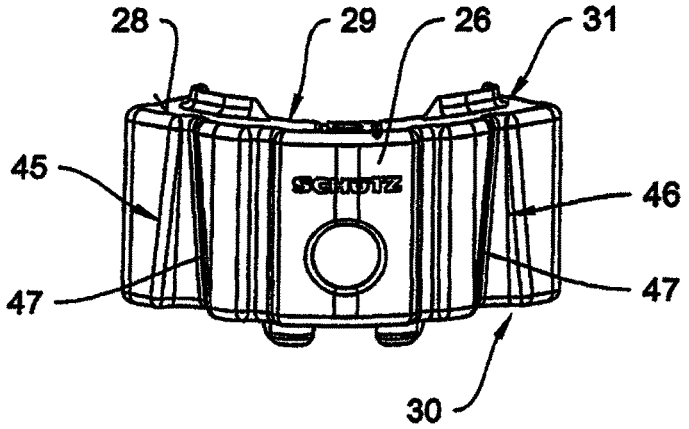
FIG. 3 shows an isometric single view of a corner foot.

As can be seen from a combined view of FIGS. 2 and 3, the corner foot 23 has a front wall 26 which is substantially curved in accordance with a frame corner 27 of the base frame 25 and on its peripheral edge 28 goes over into an edge web 29 bent towards the inner region of the base frame 25 which comprises a lower edge web section 30 and an upper edge web section 31. The lower edge web section 30 is used for connection to the base frame 25. The upper edge web section 31 is used for connection to a lower edge 32 of the outer jacket 18 in such a manner that a peripheral edge 33 of the base 22 is accommodated between the upper edge web section 31 (FIG. 3) and the lower edge 32 of the outer jacket 18.

Figure 5:
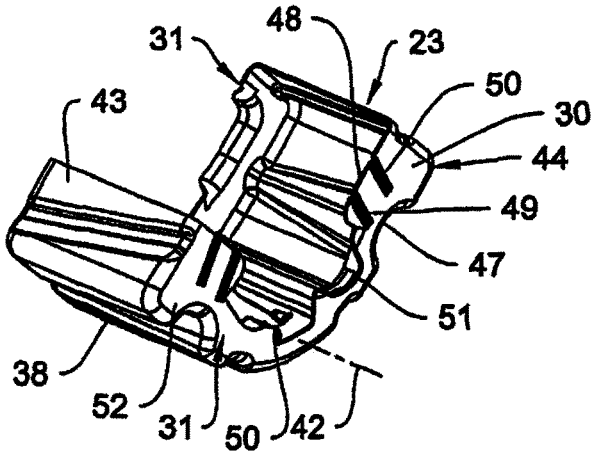
FIG. 5 shows a corner foot produced on the basis of the corner foot pre-form shown in FIG. 4 in isometric view from below.
Figure 4:
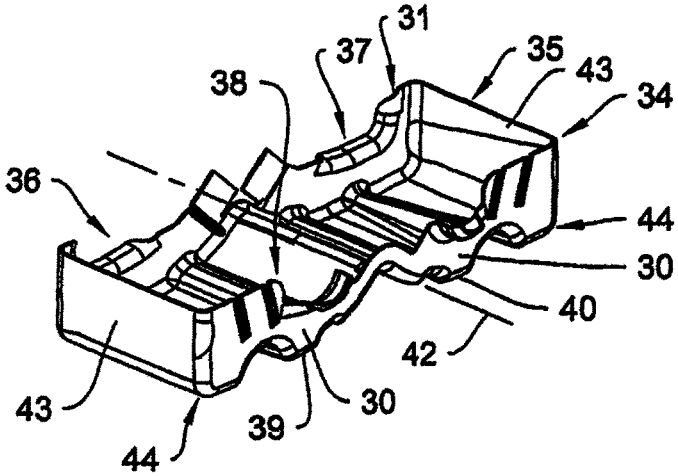
FIG. 4 shows a corner foot pre-form in isometric view.

FIG. 4 shows a corner foot pre-form 34 which is produced in a deep-drawing process and is formed into the corner foot 23 shown in FIG. 5 in another following forming process. The corner foot pre-form 34 has a substantially box- or cup-shaped corner foot body 35 with two cup parts 36, 37 which are interconnected via a common base wall.

In the corner foot pre-form 34 the base wall 38 is formed from two cylinder jacket segments 39, 40 of the cup parts 36, 37 which go over into one another in the area of a central axis 42 of the base wall 38. As FIG. 4 further clearly shows, in addition to the lower edge web section 30 and the upper edge web section 31, the cup parts 36, 37 have a lateral edge web section 43 which in the edge web forming region 44 goes over continuously into the upper edge web section 31 and the lower edge web section 30.

In the corner foot pre-form 34 the web edge forming regions 44 are formed as spatial corner regions of the cup parts 36, 37 in which the lower edge web section 30, the upper edge web section 31 and the adjoining region of the base wall 38 are arranged relative to one another according to the principal axial directions of the space. As a result of the manufacture of the corner foot pre-form 34 shown in FIG. 4 based on a flat sheet metal blank, the web edge forming regions 44 are formed at the same time as the cup parts 36, 37 when executing the deep drawing process. The corner foot pre-form 34 shown in FIG. 4 is therefore the result of a single forming process using a correspondingly configured stamping or deep drawing tool.

The corner foot 23 shown in FIG. 5 is manufactured starting the corner foot pre-form 34 shown in FIG. 4 whereby in a further forming process the cup parts 36, 37 are pivoted with respect to one another about a pivot axis substantially coinciding with the central axis 42 of the base wall 38. The pivoting is accomplished to such an extent that the base partial surfaces of the base wall 38 of the corner foot pre-form 34 here configured as cylinder jacket segments 40, 41 form the front wall 26, in which the cylinder jacket segments 40, 41 are partial surfaces of a complete surface having a substantially continuous radius of curvature—apart from the profiling of the front wall by beads or similar.

In particular FIGS. 2 and 3 show that the front wall 26 is provided with stiffening beads 45, 46 which extend between the upper edge web section 31 and the lower edge web section 30 and have a bead base 47 which is inclined with respect to a front plane defined by the front wall 26 towards a connecting edge 48 of the lower edge web section 30 shown in FIG. 5. In the case of the present exemplary embodiment, the connecting edge 48 has two web-shaped welding humps 49 which are used to produce a weld connection to the base frame 25. As is apparent in particular from FIG. 2, a direct force transmission, free from tilt moments is possible between the lower edge 32 of the outer jacket 18 or the base 22 and the base frame 25 due to the inclined arrangement of the bead base 47.

Figure 6:
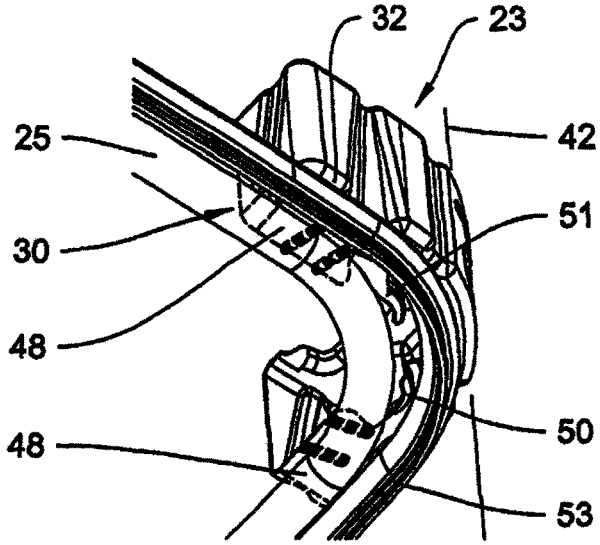
FIG. 6 shows a corner foot in stack configuration.

FIGS. 5 and 6 show in particular that on its lower edge web section 30 the corner foot 23 is provided with a stop tab 50, 51 on both sides of the central axis 42, which, in an arrangement of the corner foot 23 in stack configuration shown in FIG. 6, i.e. when the corner feet 23 of an upper transport and storage container 10 are located on an upper edge 53 (see FIG. 1) of the outer jacket 18 of a lower transport and storage container 10, separate a contact edge 52 of the lower edge web section 30 from the connecting edge 48 of the lower edge web section 30 which is used for the weld connection to the base frame 25. In this case, the stop tabs 50, 51 are formed so that they define the distance between the upper edge 53 of the outer jacket 18 of the lower transport and storage container 10 from the base frame 25 of the upper transport and storage container 10 located thereon in the stack configuration. In an arrangement of the stop tabs 50, 51 at all four corner feet of the transport and storage container, a defined free distance, running around the base frame 25, is thus obtained between the base frame 25 of the upper transport and storage container 10 and the upper edge 53 of the lower transport and storage container 10.

The invention claimed is:

1. A pallet-like underframe for transport and storage containers for liquids, which are equipped with a plastic inner container with a closable filler connection and a drain connection for connection to a drain fitting and an outer jacket comprising a metal grid or sheet metal, the underframe comprising:

a base for supporting the inner container; and corner feet mounted on a base frame on which the base of the underframe is mounted, wherein a corner foot of the corner feet comprises a cup-shaped corner foot body having a front wall curved in accordance with a corner radius of a frame corner of the base frame and cup parts formed to the side of a central axis of the front wall, wherein the cup parts each comprise an inwardly bent edge web formed on a peripheral edge of the front wall, said edge web comprising an upper edge web section for engagement of the corner foot to the base, a lower edge web section for connection to the base frame, and a lateral edge web section formed between the upper and the lower edge web section on a side edge of the front wall, wherein the upper edge web section, the lateral edge web section, and the lower edge web section are configured to go over into one another continuously in edge web forming regions.

2. The underframe according to claim 1, in which the edge web forming regions are configured as spatial corner regions of the cup parts.

3. The underframe according to claim 1, in which stiffening beads are formed in the front wall, which extend between the upper edge web section and the lower edge web section and have a bead base which is inclined with respect to a front plane defined by the front wall towards a connecting edge of the lower edge web section.

4. The underframe according to claim 1, in which stop tabs are disposed on the lower edge web section between the peripheral edge of the front wall and a connecting edge, which by their distance from the peripheral edge define a contact edge for support on an outer jacket of a transport and storage container.

5. A transport and storage container for liquids which are equipped with a plastic inner container with a closable filler connection and a drain connection for connection of a drain fitting and an outer jacket comprising a metal grid or sheet metal, wherein the inner container and the outer jacket are disposed on a base of a pallet-like underframe according to claim 1.

6. A method for manufacturing a corner foot for a pallet-like underframe according to claim 1, said method comprising:

forming a flat sheet metal blank in a deep drawing process in such a manner that a corner foot moulding is formed having two cup parts formed laterally of a central axis of a base wall, wherein the base wall is composed of two jacket segments curved in the same direction, which go over into one another in the area of the central axis and the cup parts on the peripheral edge of the base wall each comprise an edge web formed continuously from an upper edge web section, a lateral edge web section and a lower edge web section, located substantially at right angles to the base wall and in a subsequent process step the jacket segments are pivoted with respect to one another about the central axis in such a manner that the jacket segments form a front wall having a substantially continuous radius of curvature.

* * * * *